US006043007A

United States Patent [19]

Abe

[11] Patent Number: 6,043,007

[45] Date of Patent: Mar. 28, 2000

[54] COLOR DEVELOPER COMPOSITION FOR PHOTOGRAPHY

[75] Inventor: Akira Abe, Kanagawa, Japan

[73] Assignee: Fuji Photo Film Co., Ltd., Kanagawa, Japan

[21] Appl. No.: 09/285,236

[22] Filed: Apr. 2, 1999

[30] Foreign Application Priority Data

Apr. 3, 1998 [JP] Japan ..... 10-091729
Jun. 17, 1998 [JP] Japan ..... 10-170167

[51] Int. Cl.[7] ..... G03C 7/413

[52] U.S. Cl. ..... 430/403; 430/466; 430/497

[58] Field of Search ..... 430/403, 465, 430/466, 497

[56] References Cited

U.S. PATENT DOCUMENTS

| | | | |
|---|---|---|---|
| 2,843,484 | 7/1958 | Baxendale . | |
| 2,846,308 | 8/1958 | Baxendale . | |
| 3,574,619 | 4/1971 | Surash . | |
| 3,647,461 | 3/1972 | Surash et al. . | |
| 5,384,233 | 1/1995 | Kuse et al. | 430/403 |
| 5,660,973 | 8/1997 | Ishikawa et al. | 430/466 |
| 5,891,608 | 4/1999 | Hashimoto et al. | 430/466 |

FOREIGN PATENT DOCUMENTS

| | | |
|---|---|---|
| 831928 | 1/1970 | Canada . |
| 8-234382 | 9/1996 | Japan . |
| 9-269574 | 10/1997 | Japan . |
| 2 016 723 | 3/1979 | United Kingdom . |

*Primary Examiner*—Hoa Van Le
*Attorney, Agent, or Firm*—Sughrue, Mion, Zinn, Macpeak & Seas, PLLC

[57] ABSTRACT

Disclosed is a color developer composition for photography which is used for preparing a color development replenisher; with the composition comprising at least one color developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl)aniline and salts thereof, having a specific gravity ranging from 1.05 to 1.18, and being kept in a container which is made up of high-density polyethylene alone as a plastic material so that the average weight thereof per unit surface area is from 0.04 to 0.09 g/cm$^2$, thereby ensuring sufficient stability in the composition and recyclability for the container.

15 Claims, 1 Drawing Sheet

COLOR DEVELOPER COMPOSITION FOR PHOTOGRAPHY

FIELD OF THE INVENTION

The present invention relates to a color developer used for processing silver halide color photographic materials and a development-processing method using the aforesaid developer. More specifically, the invention relates to a color developer composition for color photography that is stored in a recyclable container and has easiness of handling, transportation suitability and high storage stability.

BACKGROUND OF THE INVENTION

The processing of silver halide photographic materials, e.g., silver halide color photographic materials, generally comprises as basic steps a color developing step, a desilvering step and an image stabilizing step, such as a washing step. In the color developing step, the color developing agent reacts with silver halide to generate imagewise dyes and developed silver. In the desilvering step, the developed silver generated in the color developing step is converted into the silver salt by the oxidation (bleaching) with a bleaching agent having an oxidizing action, and further removed from the light-sensitive layer together with the silver halide remaining unused therein through the reaction with a fixing agent capable of forming a soluble silver salt. In another way, the conversion into silver salts by oxidation and their removal are carried out at one step by the use of a bleach-fix bath. The image stabilizing step is a process of controlling the image layer atmosphere so as to secure the long-term stability of images formed. Therein, the washing with water or the processing with the combination of water and an image stabilizing bath, a stabilizing bath instead of water or so on is carried out.

Each of the processing steps, excepting a washing step, is effected using a water solution containing at least one processing chemical (which is referred to as a processing solution). Since each processing solution has a relatively low concentration, the way in which the processing solutions are produced by a maker of processing chemicals in a condition that they can be used as they are, transported to processing laboratories and stored therein is generally unsuitable from the viewpoint of economy, storage space or working efficiency.

Hitherto, this problem has been solved by two methods. In one of these methods, the powdery processing chemicals to constitute the desired processing solution are mixed in the ratio corresponding to the composition of the processing solution, the powdery mixture obtained is wrapped up and supplied to processing laboratories as the so-called solid processing chemicals. And the desired processing solution is prepared in each processing laboratory by dissolving the solid processing chemical in a proper amount of water. In the other method, concentrated liquid chemical is prepared by dissolving processing chemicals as constituents of the desired processing solution in high concentrations, charged into containers and supplied to processing laboratories. And the desired processing solution is prepared in each processing laboratory by diluting the concentrated prepared liquid chemical with water or the like to a definite concentration. The former method is described in U.S. Pat. Nos. 2,843,484 and 2,846,308, Canadian Patent 831,928, and so on; while the latter method, specifically the concentrated prepared liquid chemicals for color development, is described in U.S. Pat. Nos. 3,574,619, 3,647,461 and 3,814,606, and British laid-open patent application 2,016,723. Which method has an advantage over the other depends on the scale of a processing laboratory. Small-scale processing laboratories, such as the so-called mini laboratories, micro laboratories or over-the-counter laboratories, which have lately increased in number, are generally in a situation that they have neither proficient technical expert nor full-scale incidental facilities. Under such a working condition, the liquid processing chemicals which can be easily mixed with cold water and require neither hot water supply system nor stirring equipment are preferable to the solid processing chemicals, such as powdery, granular or tabular processing chemicals, which require rather complicate working to render the handling difficult and further need a stirring equipment as well as a hot water supply system. Therefore, concentrated prepared liquid chemicals have come to be prevailingly employed in small-scale processing laboratories.

However, the liquid processing chemicals have a defect that their components are subject to aerial oxidation and some components thereof are reactive to one another. Therefore, certain measures have been taken. For instance, each liquid chemical is divided into two or more parts for the purpose of preventing the reaction between components to ensure long-term storage stability, and stored in separate containers slightly pervious to oxygen with the intention of protecting each part against aerial oxidation. In the case of a color developer, the stability of which is regarded as especially important, the liquid processing chemical divided into three parts, specifically the alkali agent part, the color developing agent part and the preservative (e.g., hydroxylamine) part, is usually employed.

On the other hand, containers usable for storing liquid processing chemicals and protecting them from aerial oxidation have been investigated. As containers that enable almost perfect prevention of aerial oxidation, glass containers have so far been used, but they are inconvenient for handling because of their fragility. Therefore, containers made of a composite material, which is formed by laminating a plastic material slightly pervious to oxygen and a plastic material inert toward development-processing solutions, have also been employed. However, they have drawbacks of being expensive and undesirable for preservation of the environment because they are lacking in recycling suitability.

From the viewpoint of environmental protection, it is desirable for the containers to be recyclable, and so it is required for them to be made of a single material. As examples of a single-component plastic material recyclable and slightly pervious to oxygen, mention may be made of polyester resins and nylon resins. However, these resins are lacking in chemically sufficient stability to development-processing chemicals having strong alkalinity, so that their being used in practice causes problems. Accordingly, plastic materials having stability to development-processing solutions, being recyclable and enabling the container formation with a single-component material are limited practically to olefin resins, such as polyethylene and polypropylene. However, these resins have a weak point that they cannot prevent aerial oxidation because of their high perviousness to oxygen, so that there is a drawback to their application to color development processing chemical compositions although they are practical as the container material for bleach compositions and fixer compositions.

And what is even worse, the polyolefin resins, particularly polyethylene, have a drawback of generating color stains that have their roots in developing agents. The color developers for color photosensitive materials are generally p-phenylenediamine derivatives. Of such derivatives, 4-amino-3-methyl-N-ethyl-N-(β-hydroxyalkyl)anilines (wherein the hydroxyalkyl moiety contains 2–4 carbon atoms) and acid salts thereof have strong developing activity, and so they are prevailingly used for color negative films, coupler-in-developer-type color photosensitive materials and so on. When they are charged into a polyethylene container, those color developing agents not only suffer deterioration due to aerial oxidation but also penetrate into the inner part of the container wall to color the container brown, in contrast to many other developing agents of similar type, such as acid salts of 4-amino-3-methyl-N-ethyl-N-(β-methanesulfoamidoethyl)aniline. On the other hand, the recycling of the thus colored polyethylene as a container material and for other uses has turned out to be subject to serious restrictions. The coloration caused in the container material has a nature of not allowing the removal by washing.

Such being the case, the particularly desired color developer composition is a color developer composition that is charged in a container made up of a single material, enabling stable storage of the contents, free from coloration and recyclable at a low cost, contains at least one developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl)aniline and the salts thereof, and adjusted to pH 10–12.

Additionally, the term "recycle" as used herein means that the used containers are regenerated as new containers through a recycling process, but does not refer to the reuse as repeated use of the same container.

SUMMARY OF THE INVENTION

An object of the invention is therefore to solve the aforementioned problem that confronts the recycling of polyolefin containers, especially polyethylene containers, and provide a color developer composition charged in a recyclable container. To mention more specifically, the object of the present invention is to provide a color developer composition used for preparing a color development replenisher, which contains as a color developing agent at least one developing agent selected from the group consisting of 4-amino-3-methyl-N-ethyl-N-(β-hydroxyalkyl) anilines (wherein the hydroxyalkyl moiety has 2–4 carbon atoms) and salts thereof, namely the developing agents prevailingly used for color negative films and the like, has practically sufficient storage stability and can ensure the recycling of the container in which the composition is charged.

As a result of our intensive studies to achieve the aforementioned object, it has been found that the coloration of the container is influenced by physical properties of polyethylene, including the density, and characteristics of a color developer charged in the container, including specific gravity and pH. By further investigation on the basis of this finding, the present invention is achieved. In other words, the object of the present invention is attained with a particular combination of the following conditions concerning a plastic container and a concentrated liquid processing chemical composition for color development:

1. A color developer composition for photography which is used for preparing a color development replenisher; characterized in that the composition comprises at least one color developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl) aniline and salts thereof, has a specific gravity ranging from 1.05 to 1.18, and is kept in a container which is made up of high-density polyethylene alone so that the average weight thereof per unit surface area (weight/surface area) is from 0.04 to 0.09 g/cm$^2$.

2. A color developer composition as described in the foregoing embodiment 1, further comprising a sulfite in a concentration of from 0.01 to 0.20 mole/l.

3. A color developer composition as described in the foregoing embodiment 1 or 2, wherein the high-density polyethylene is polyethylene having a melt index of from 0.3 to 7.0 g/10 min and a density of from 0.951 to 0.969.

Of the development-processing methods using the present color developer compositions as described above, the method in which the present color developer composition is loaded into an automatic developing machine (automatic processor), which is designed so as to be replenished automatically with replenishers, is preferred as an embodiment which can strikingly draw out the effects of the present invention. In particular, the method of processing silver halide color photographic materials, which comprises loading the container filled with the present color developer composition into an automatic developing machine, pouring the content of the container into a replenisher tank for development, washing the interior of the container with a definite amount of water and, at the same time, introducing the water used for washing into the replenisher tank to utilize as water for preparing a replenisher and carrying out the development-processing by the use of the replenisher obtained, is an embodiment capable of demonstrating strong points of the present invention.

DETAILED DESCRIPTION OF THE INVENTION

Figure 1:
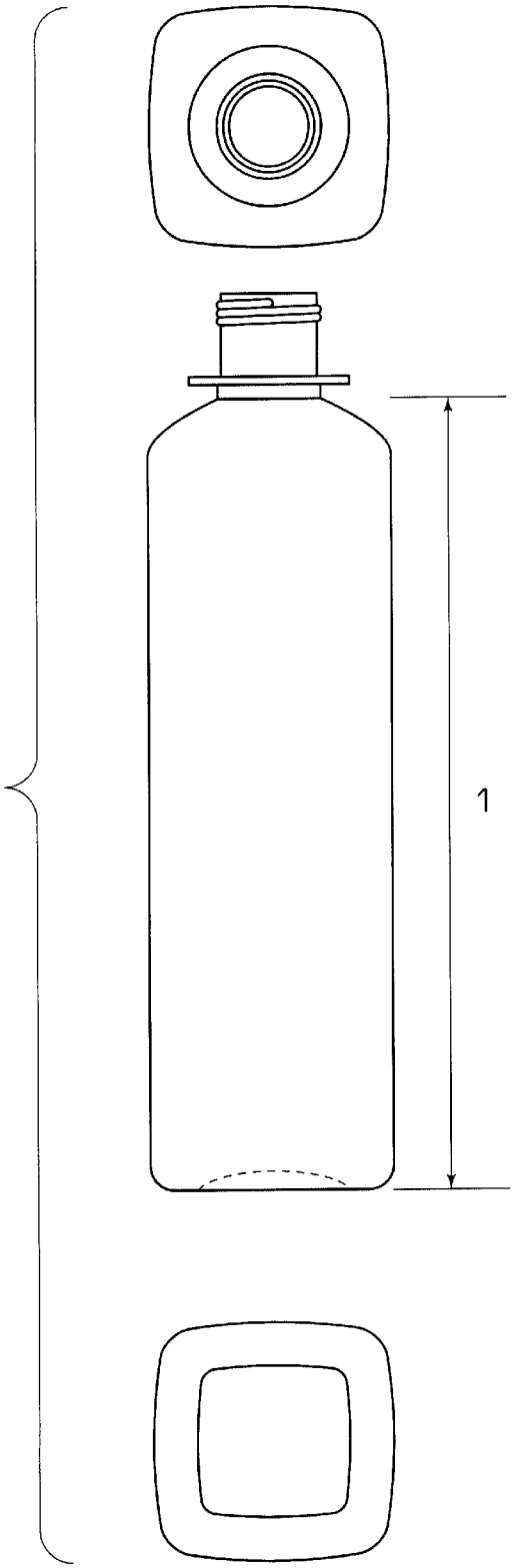
FIG. 1 is an illustration showing a bottle for storing a developer composition relating to an embodiment of the present invention.

The forms embodying the present invention are illustrated below in greater detail.

The present invention achieves the object of enabling the recycling of containers while keeping photographic characteristics and other properties required for a concentrated liquid developer composition applied to color photographic materials by improving both the constitution of the composition and the container in which the composition is stored. The constitution of the present invention consists in that the photographic color developer composition containing a color developing agent prevailing on the current color photographic market, namely 4-amino-3-methyl-N-ethyl-N-(β- hydroxyalkyl)aniline (wherein the hydroxyalkyl moiety has from 2 to 4, preferably 2, carbon atoms) or a salt thereof (the term "salt thereof" is omitted hereinafter when these agents are designated), and having its specific gravity in the range of 1.05 to 1.18 is employed as a replenisher component for color development and charged in a container made up of high-density polyethylene alone so that the average weight thereof per unit surface area (the total weight of empty container/the total outer surface area of container) is from 0.04 to 0.09 g/cm$^2$. As far as these constitution requirements are satisfied, the developer composition put in the polyethylene container colors neither itself nor the container upon storage, or the container does not suffer from the adhered color stains difficult to remove. Therefore, the photographic properties can be kept consistent, and the container can be recycled after use. In the pH range 10.0–12.0, or a pH range widely used for the color developer of the foregoing type, the coloration of a container usually tends to occur, and the colored containers (bottles) are unfit for recycling. Further, the adhered color stains arising from an oxidized color developing agent are difficult to remove by washing, and so they make the recycling of the container still more difficult. In other words, the present invention enables a color developer composition to be stabilized and a container to be recycled after use by controlling the specific gravity of the developer composition and selecting a proper material for the container. Accordingly, detailed description of the container is first given, and then the components of the developer composition are described in detail.

In the present invention, polyethylene is used as the material for a container of color-development processing chemicals with the intention of enabling the container to be recycled. In particular, remarkable improvements are achieved by using high-density polyethylene (hereinafter referred to as "HDPE" in short) as a single material for making the container and adjusting the average weight per area as defined below to 0.04–0.09 g/cm$^2$.

The reason why the coloration arising from a developing agent can be reduced by the use of high-density polyethylene remains unclear, but it is assumed that the crystallization and orientation of polyethylene chains probably proceed in a process of producing high-density polyethylene to create a structure into which a color developing agent is hard to penetrate. The HDPE used in the present invention preferably has a density of from 0.951 to 0.969. The polyethylene having its density in that range is produced using a polymerization process belonging to the so-called medium pressure process or low pressure process, e.g., Ziegler processor Phillips process, and known to have high crystallinity because it is made up of linear molecules having few branches.

The use of HDPE as a material for making a container is required for preventing the container from being colored. The coloration of a HDPE-made container can be more effectively prevented by controlling the amount of HDPE used per area of the container so as to be within the range of 0.04 to 0.09 g/cm$^2$, expressed in terms of an average weight per unit surface area. This measure corresponds to the value obtained by dividing the weight of the body 1 of an empty container as shown in FIG. 1 by the outer surface area of the body 1 (including the area of the bottom part). This value reflects the amount of the material used per outer surface area of the container. The container is usually a bottle. When the bottles are molded, the side, mouth and bottom parts thereof are not necessarily uniform in thickness, so that the thickness or weight of a particular part cannot represent properly the amount of the material used. Such being the case, the aforementioned measure, or the average weight of the material used per unit outer surface area, is adopted in the present invention. Hereinafter, this measure is referred to as "average weight per unit surface area". In a case where the average weight per unit surface area is less than the lower limit of the range 0.04–0.09 g/cm$^2$, the deterioration arising from aerial oxidation proceeds rapidly, the color developer composition itself comes to stain with the lapse of time. As a result, the color stain separates from the liquid and adheres to the inner wall of the container and, at the same time, the preservative concentration and the developing agent concentration are lowered to cause progressive deterioration in photographic properties. In another case where the average weight per unit surface area is increased beyond the upper limit of the foregoing range, the coloration due to aerial oxidation of the color developer composition itself and the lowering of preservative and developing agent concentrations are reduced. In this case, however, the container tends to be stained by the color developing agent penetrated thereinto; as a result, the recycling thereof becomes difficult. Accordingly, it is required for the average weight per unit surface area to be within the aforesaid range, preferably from 0.04 to 0.08 g/cm$^2$.

It is desirable that the container used in the present invention be made using HDPE having its density in the foregoing range so that the average weight per unit surface area is controlled to the aforesaid range. In addition, it is advantageous that the HDPE used has a melt index ranging from 0.3 to 7.0 g/10 min, preferably from 0.3 to 5.0 g/10 min (measured at 190° C. under the extrusion pressure of 2.16 kg according to the method defined in ASTM D1238). When the melt index of HDPE is within the foregoing range, the coloration of the HDPE container by aging and the adhesion of color stains to the inner wall of the container is prevented from occurring. The reason therefor is also obscure, but it is presumed that the desired small-sized, relatively thin bottles can be molded with ease so far as the HDPE has its melt index in the foregoing range; as a result, the bottles molded can have the thickness (or the intended average weight per unit surface area) answering the present purpose and be highly uniform in thickness and highly accurate in dimensions. It is desirable that the HDPE containers used in the present invention be manufactured using blow molding methods, especially an injection blow molding method.

Now that the explanation of the container is finished, the components of a color developer composition according to the present invention are illustrated below.

In order to secure the stability of a color developer composition and the recyclability of a container by prevention of coloration therein, the present invention requires that the specific gravity value of the color developer composition be from 1.05 to 1.18. In a case where the specific gravity value is lower than the lower limit of that range, the deterioration of the composition due to aerial oxidation proceeds rapidly, in analogy with the case where the container has a less average weight per unit surface area. As a result, the color developer composition itself stains, the colored matter separated from the composition adheres to the inner wall of the container, and the preservative and developing agent concentrations are lowered to cause deterioration in photographic properties. In proportion to the progress of coloration in the color developer composition itself, the coloration of the container is deepened. In a case where the specific gravity value is higher than the upper limit of the foregoing range, on the other hand, the penetration of the color developing agent into the container increases, which is accompanied by an increase in coloration of the container. Accordingly, both reduction in coloration of the container and improvement in stability of the color developer composition are attained by controlling the specific gravity value to the foregoing range. The specific gravity value ranges preferably from 1.08 to 1.15, more preferably from 1.08 to 1.13, and particularly preferably from 1.10 to 1.12.

The simplest means to raise a specific value of the color developer composition to the foregoing range consists in heightening the concentration degree of the composition. In order that the precipitation of components under the restriction on solubility is avoided in the course of heightening the concentration degree, it is effective to select each component from compounds having the same function but relatively high solubility and little ill-influence upon photographic properties. For instance, potassium carbonate is selected as the alkali agent, and potassium chloride is selected as the chloride. Another means for raising the specific gravity within the allowable range of photographic properties consists in heightening the proportion of alkali carbonates capable of having a bid contribution to the specific gravity, particularly potassium carbonate, to the total alkali agents (including alkali carbonates, potassium hydroxide and sodium oxide) in the composition. Further, alkali-soluble inorganic or organic acid salts having no pH buffering function in the vicinity of the pH range 9–12 and little influences on photographic properties, examples of which are recited hereinafter, may be added only for the purpose of adjusting the specific gravity. Furthermore, it is desirable to add the dissolution aids as recited below for elevating the solubility of each component.

Examples of a water-soluble dissolution aid suitable for elevation of solubility of each component include alcohols, such as methyl alcohol, ethyl alcohol, propyl alcohol and isopropyl alcohol; glycols, such as ethylene glycol, diethylene glycol, triethylene glycol and polyethylene glycols having molecular weight of no higher than 6,000; alkanolamines, such as diethanolamine and triethanolamine; sodium paratoluenesulfonate and potassium paratoluenesulfonate. In particular, diethylene glycol and paratoluenesulfonic acid salts are preferred over the other dissolution aids.

In addition, it is desirable to raise the specific gravity by adding sodium carbonate, potassium carbonate, or sodium or potassium salt of a chelating agent, which are known as a component of a color developer or a replenisher for color development, in a greater proportion than usual to other components. Examples of such a chelating agent include ethylenediaminetetraacetic acid, diethylenetriaminepentaacetic acid, 1-hydroxyethylidene-1,1-diphosphonic acid, hydroxyethyliminodiacetic acid, ethylenediaminetetramethylenephosphonic acid and nitrilotrimethylenephosphonic acid.

Further, the specific gravity can be adjusted by the addition of compounds having little influence upon the properties of color developer. Examples of such a specific gravity modifier which may be added to the color developer composition include alkali metal sulfates or chlorides, such as sodium sulfate, potassium sulfate, sodium chloride and potassium chloride, and sodium, potassium or lithium salts of organic acids, such as acetic acid, oxalic acid, citric acid, maleic acid, succinic acid, tartaric acid, adipic acid, glycolic acid, lactic acid and glutaric acid. Besides these modifiers, the various monosaccharides disclosed in JP-A-6-02627 (the term "JP-A" as used herein means an "unexamined published Japanese patent application") may be added.

Also, the sulfinic acids disclosed in JP-A-224762, such as paratoluenesulfinic acid and metacarboxysulfinic acid, and the salts thereof may be added.

Of the specific gravity modifiers recited above, the sulfates, the sulfinates, soluble starch and saccharose are preferred over the others.

Although a clear account of the mechanism which controls the present specific gravity control effects cannot be given, it is presumed that the specific gravity value is probably a physical property value reflecting the activity of water in the composition, and so the activity range of water in the composition, which enables reductions in the rate at which the processing chemicals take up the oxygen and carbon dioxide in the air, the rate at which processing components react with one another, the adsorption of a color developing agent or oxidation products thereof onto the inner wall of a container and so on, appears as the specific gravity range mentioned above.

In cases where 4-amino-3-methyl-N-ethyl-N-(β-hydroxyethyl)aniline, 4-amino-3-methyl-N-ethyl-N-(β-hydroxypropyl)aniline and 4-amino-3-methyl-N-ethyl-N-(β-hydroxybutyl)aniline are used as -color developing agent, it is confirmed that the effects aimed at by the present invention are achievable by controlling the specific gravity of the composition to such a particular range as mentioned above. Therefore, the present invention utilizes those compounds as color developing agent. Those compounds can be used in the form of chloride, sulfate, carbonate, phosphate, arylsulfonates such as p-toluenesulfonate, and the like. Of these forms, the sulfate form is preferred in particular.

Moreover, the color developer composition is made harder to undergo aerial oxidation by containing 0.01–0.20 mole/l of sulfites; as a result, the coloration of the color developer composition itself and the lowering of preservative and developing agent concentrations, which causes the deterioration in photographic properties, are reduced. In particular, containing sulfites in such amounts is highly effective in preventing the container from coloring and a colored matter from adhering to the container wall. The less the amount of sulfites added, the smaller the effect of sulfite addition. Even if the amount added is increased, however, sulfites react with other preservatives present together to cause deterioration in photographic properties. Therefore, it is required that the sulfite concentration be in the range of 0.01 to 0.20 mole/l, preferably 0.02 to 0.15 mole/l, more preferably 0.03 to 0.10 mole/l.

Making an additional remark, the case of storing a color developer in a polyethylene container is disclosed in JP-A-9-311425 concerning the color developer composition having high concentration and high alkalinity. However, the pH region specified therein (13 or higher) is higher than the ordinary pH region (from 10 to 12) employed in the case of developing agents as used in the present invention (e.g., 4-amino-3-methyl-N-ethyl-N-(β-hydroxyethyl)aniline), and that the above-cited reference is silent on the use of the color developing agents as an subject matter of the present invention (e.g., 4-amino-3-methyl-N-ethyl-N-(β-hydroxyethyl) aniline) and the specifications for the polyethylene container. Accordingly, the developer composition forming the subject of the cited invention is different from that of the present invention. Moreover, the cited invention has no suggestion on the effects of the present invention.

JP-A-6–234389 relating to improvements upon preserving properties of hydroxylamine discloses the specific gravity values overlapping with the specific gravity range specified by the present invention, and has a description of polyethylene containers. However, this reference is silent on the use of the color developing agents as a subject matter of the present invention (e.g., 4-amino-3-methyl-N-ethyl-N-(β-hydroxyethyl)aniline) and the specifications for the polyethylene container, and that has no suggestion on the effects of the present invention.

Therefore, any of those color developer compositions, their containers and known matters relating thereto, or even the combination thereof gives no suggestion about the knowledge discovered by the present invention.

In the present invention, the development-processing chemical composition is not necessarily structured as one-liquid chemical. The one-liquid chemical is easy to handle, but a structure that the composition is divided into two or more liquid chemicals may be taken from the viewpoint of ensuring the stability for the composition. For instance, a two-part structure made up of the part containing a hydroxylamine derivative as preservative and the part containing a color developing agent is a preferred embodiment of the present invention.

Additionally, hereinafter, the terms "one-liquid processing chemical", "processing chemical of two-liquid structure" and the like are also referred to as "processing chemical of one-part structure" and "liquid chemical of two-part structure" according to the International Standard ISO 5989.

In preparing a replenisher for development or a developer from the developer composition, all the parts forming the composition are mixed with water for dilution. Therein, it often happens that the desired pH is not attained only by the dilution with water, so that the pH correction or adjustment is carried out by the addition of alkali agents (or acid agents). In such cases also, the composition is referred to as a composition of one-part structure so far as the alkali (or acid) agent does not form a separate part.

The embodiments concerning the constitutional requirements for the present invention are described above. In the next place, preferred embodiments of liquid chemical components of the present developer composition and those of the present container are illustrated in further detail.

Besides meeting the constitutional requirements, the present developer composition can have a further rise in stability by addition of the alkylene glycols mentioned below and the hydroxylamine derivatives having particular structures as illustrated below.

The polyalkylene glycols capable of producing effects when added to the present color developer composition are represented by the following formula (I):

$$HO(EtO)_n(PrO)_mH \quad (I)$$

In the above formula, EtO stands for an ethyleneoxy group, PrO stands for a propyleneoxy group, n is an integer of from 1 to 50, preferably from 2 to 30, and m is zero or an integer of from 3 to 40, preferably zero or an integer of from 5 to 30. In particular, m=0 is advantageous. When m is not zero, both the number of polyoxypropylene groups and the number of polyoxyethylene groups may be at least two in the block copolymer represented by formula (I).

The suitable polyalkylene glycols are polyalkylene glycols having relatively low molecular weight and block copolymers of polyethylene glycol and polypropylene.

In particular, polyalkylene glycols having molecular weight ranging from 62 to 1,500, including diethylene glycol and triethylene glycol, are advantageous. Further, diethylene glycol, triethylene glycol and polyethylene glycols having molecular weight ranging from 100 to 800, especially from 200 to 500, are effective. Suitable block copolymers of ethylene glycol and propylene glycol are those which has molecular weight in the range of 200 to 2,000 and contains ethylene glycol units in a proportion of 50–90 weight %. Of these block copolymers, those having molecular weight in the range of 300 to 1,000 and contains ethylene glycol units in a proportion of 50 to 80 weight % are preferred over the others. Additionally, needless to say, each molecular weight defined above is average molecular weight (irrespective of number average or weight average).

The suitable amount of polyalkylene glycols added is in the range of 1.0 to 100 g/l, preferably 5.0 to 50 g/l.

Besides the aforementioned alkylene glycols of formula (I), hydroxylamine derivatives represented by the following formula (II) can be added to the present development-processing chemical composition to further enhance the preserving properties:

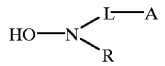

(II)

When L represents an alkylene group in the above formula (II), the alkylene group is a straight-chain or branched alkylene groups containing 1 to 10 carbon atoms, preferably 1 to 5 carbon atoms, which may have a substituent group. Suitable examples of such an alkylene group include methylene, ethylene, trimethylene and propylene. Suitable examples of such a substituent group include a carboxyl group, a sulfo group, a phosphono group, a phosphinic acid residue, a hydroxyl group and an amino group which may be substituted by an alkyl (preferably 1–5C alkyl) group. Of these groups, carboxyl, sulfo, phosphono and hydroxyl groups are preferred over the others.

When L is an alkylene group, A represents a carboxyl group, a sulfo group, a phosphono group, a phosphinic acid residue, a hydroxyl group, an amino group which may be substituted by an alkyl group (preferably a 1–5C alkyl group), an ammonio group which may be substituted by an alkyl (preferably 1–5C alkyl) group, a carbamoyl group which may be substituted by an alkyl (preferably 1–5C alkyl) group, a sulfamoyl group which may be substituted by an alkyl (preferably 1–5C alkyl) group, or an alkylsulfonyl group which may have a substituent group. Of these groups, carboxyl, sulfo, hydroxyl, phosphono, carbamoyl and alkyl-substituted carbamoyl groups are preferred over the others. When A represents an ammonio group, the compound of formula (II) may be accompanied by a counter ion, such as a sulfate, p-toluenesulfonate, chloride or sulfite ion. When L and A are each accompanied by a substituent group having an acid radical, such as a carboxyl group, a sulfonic acid group, a phosphono group, a phosphinic acid residue or a hydroxyl group, the H of the acid radical may be replaced by an alkali metal atom or an atomic group like ammonium. Suitable examples of a moiety of formula —L—A include carboxymethyl, carboxyethyl, carboxypropyl, sulfoethyl, sulfopropyl, sulfobutyl, phosphonomethyl, phosphonoethyl and hydroxyethyl groups. In particular, bcarboxymethyl, carboxyethyl, sulfoethyl, sulfopropyl, phosphonomethyl and phosphonoethyl groups are preferable to the others.

When L represents a single bond, A represents a 1–5C alkyl group, particularly preferably a methyl, ethyl, n-propyl or i-propyl group. Such an alkyl group may be substituted by a 1–3C alkoxy group. Suitable examples of such an alkoxy-substituted alkyl group include methoxyethyl, ethoxyethyl and methoxy-n-propyl groups.

R represents a hydrogen atom or a straight-chain or branched 1–10C, preferably 1–5C, alkyl group which may have a substituent group. Examples of such a substituent group include a carboxyl group, a sulfonic acid group, a phosphono group, a phosphinic acid residue, a hydroxyl group, an amino group which may be substituted by an alkyl group, a carbamoyl group which may be substituted by an alkyl group, a sulfamoyl group which may be substituted by an alkyl group, a n alkylsulfonyl group which may have a substituent, an acylamino group, an alkylsulfonylamino group, a n arylsulfonylamino group, an alkoxycarbonyl group, an arylsulfonyl group, a nitro group, a cyano group and a halogen atom. The alkyl group represented by R may have two or more substituent groups. Of the above-recited ones, a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group are preferred as Rover the others. In particular, a hydrogen atom, a carboxymethyl group, a carboxyethyl group, a sulfoethyl group, a sulfopropyl group, a phosphonomethyl group and a phosphonoethyl group are appropriate for R.

L and R may combine with each other to form a ring. In forming a ring by combining L and R, the ring can be formed by direct bonding of L to R to contain A as a substituent group, or by attaching L to R via the nitrogen atom in A when A is an amino group or an alkyl-substituted amino group (as in the case of forming a piperazine ring).

Specific examples of a hydroxylamine derivative usable in the present invention are illustrated below, but these examples should not be construed as limiting the scope of the invention in any way.

(11-1)

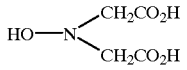

(11-2)

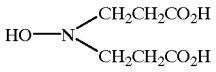

(11-3)

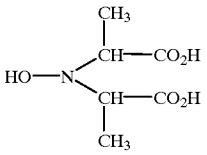

(11-4)

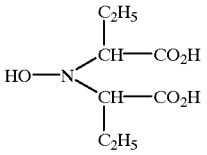

(11-5)

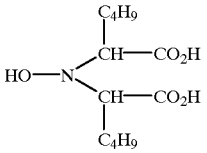

(11-6)

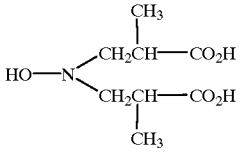

(11-7)

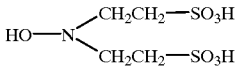

(11-8)

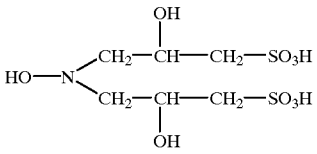

(11-9)

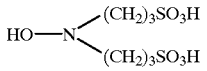

(11-10)

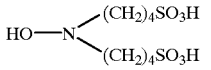

-continued (11-11)

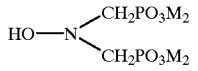

(11-12)

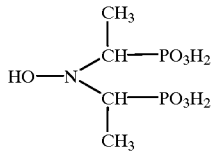

(11-13)

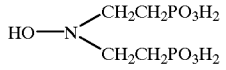

(11-14)

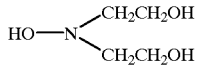

(11-15)

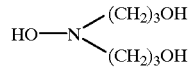

(11-16)

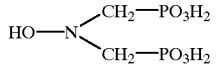

(11-17)

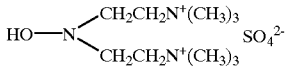

(11-18)

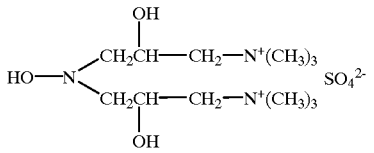

(11-19)

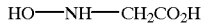

(11-20)

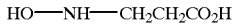

(11-21)

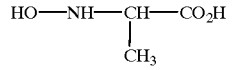

(11-22)

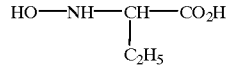

(11-23)

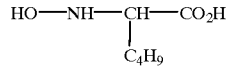

(11-24)

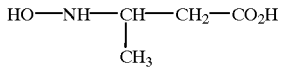

(11-25)

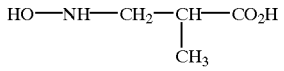

(11-26)

(11-27)

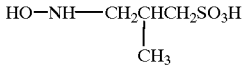

-continued (11-28)

$HO—NH—(CH_2)_3SO_3H$ (11-29)

$HO—NH—(CH_2)_4SO_3H$ (11-30)

$HO—NH—CH_2PO_3H_2$ (11-31)

$HO—NH—CH(CH_3)—PO_3H_2$ (11-32)

$HO—NH—CH_2CH_2PO_3H_2$ (11-33)

$HO—NH—CH_2CH_2OH$ (11-34)

$HO—NH—(CH_2)_3OH$ (11-35)

$HO—NH—CH_2—PO_3H_2$ (11-36)

$HO—NH—CH_2CH_2N^+(CH_2)_3$

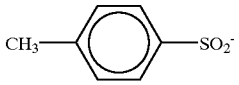

(11-37)

$HO—NH—CH_2CH(OH)CH_2N^+(CH_2)_3$

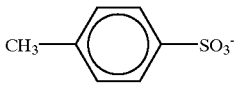

(11-38)

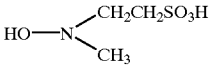

(11-39)

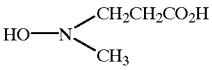

(11-40)

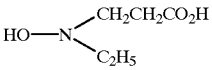

(11-41)

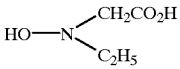

(11-42)

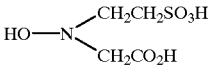

(11-43)

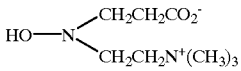

(11-44)

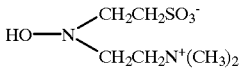

(11-45)

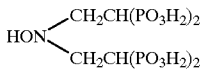

(11-46)

$HONHCH_2CH(PO_3H_2)_2$

-continued (11-47)

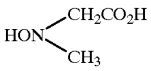

(11-48)

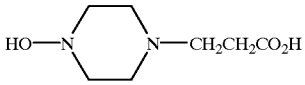

(11-49)

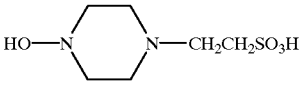

(11-50)

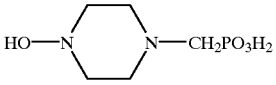

(11-51)

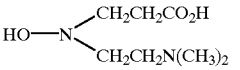

(11-52)

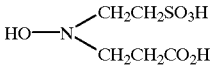

(11-53)

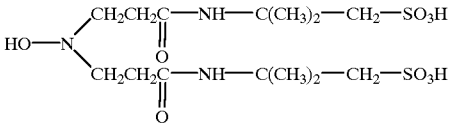

(11-54)

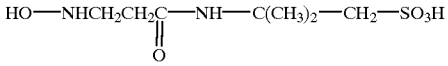

(11-55)

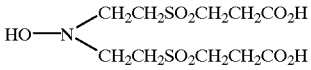

(11-56)

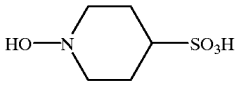

(11-57)

$HO—NH—CH_3$ (11-58)

$HO—NH—CH(CH_3)—CH_3$ (11-59)

$HO—N(C_2H_5)_2$ (11-60)

$HO—NH—CH(CH_3)_2$ (11-61)

$HONH(CH_2CH_2OCH_3)_2$

The compounds represented by formula (II) can be synthesized by subjecting commercially available hydroxylamines to an alkylation reaction (such as a nucleophilic substitution reaction, an addition reaction or Mannich reaction). Therein, the synthesis methods as described in, e.g., West German Patent 1159634 and *Inorganic Chemical Acta*, vol. 93, pages 101–108 (1984) can be adopted. Further, the synthesis methods for more specific compounds are disclosed in JP-A-3-266837.

Of compounds represented by formula (II), the Compounds II-2, II-7, II-57 and II-58 illustrated above as specific examples are preferred in particular.

The hydroxylamine derivative of formula (II) is added to the present color developer in such an amount as to have a concentration ranging from 0.001 to 1.0 mole/l, preferably from 0.01 to 0.5 mole/l, in terms of a processing tank solution component. When it is added to the replenisher, the amount added is 1.0–1.8 times, preferably 1.0–1.4 times, the amount mentioned above. In the case of adding a hydroxylamine derivative to the developer composition, the amount added is set so that the foregoing developer or replenisher is obtained by dilution corresponding to the concentration factor.

The addition of alkylene glycols represented by formula (I) or compounds of formula (II) to a color developer enables the color developer to have excellent preserving properties, and elevates the prevention effect against coloration in the developer and the container wall due to aerial oxidation.

Further, the containers suitable for the present concentrated liquid developer are illustrated below in greater detail.

To HDPE used for the container of a concentrated liquid developer composition, pigments having no adverse effect on an alkaline developing composition, such as carbon black, titan white, calcium silicate and silica, additives such as calcium carbonate and 2,6-di-t-butyl-4-methylphenol (BHT), dicetyl sulfide, tris(laurylthio)phosphite and known other antioxidants of amine, thioether and phenol types, slipping agents such as stearic acid or metal salts thereof, known UV absorbents compatible with polyethylene, from 2-hydroxy-4-n-octyloxybenzophenone down, and known plasticizers compatible with polyethylene may be added, if needed. It is desirable that the total amount of those additives be not greater than 50% of the total amount of mixed raw materials for plastic. Preferably, the proportion of polyethylene is at least 85%, especially at least 95%, and no plasticizer is added.

The material for a container cap, though not necessarily HDPE, may be LDPE. However, HDPE is preferred as the material for the cap. Even in a case where the cap is HDPE, it is unnecessary that the density and melt index thereof are the same as those of HDPE used for the container body. The HDPE for the cap can be selected from those having such grades as to ensure easy molding into caps and air tightness of the part that seals in the mouth of the container body. Also, LDPE having a density of 0.91–0.94 can be used in only the seal part of the cap, or the part at which the cap seals in the mouth of the container body. The use of LDPE in such a slight amount has practically no influence upon the recycling of polyethylene.

With respect to the molding of plastic bottles, there are known various methods, e.g., injection molding, blow molding, injection blow molding, extrusion blow molding, extrusion molding and vacuum molding methods, and therefrom the method fitting the purpose can be selected. The most popular method is a blow molding method. In the case of bottles relating to the present invention, it is desirable that the cap be made by an injection molding method and the bottle be made by a blow molding method, especially an injection blow molding method.

The shape and structure of containers into which the present concentrated liquid developer composition is charged can be designed arbitrarily depending on the purposes in using them. Besides a general standard bottle structure, it is possible to use the containers of an elastic structure as disclosed in, e.g., JP-A-58-97046, JP-A-63-50839, JP-A-1-235950 and JP-A-63-45555, and the containers having flexible partitions as disclosed in JP-A-58-52065, JP-A-62-246061 and JP-A-62-134626.

In charging the developer composition into a container, it is desirable that the upper space of the container be made as small as possible by trying to fill the container to the brim with the composition or replaced by nitrogen gas to avoid the contact with oxygen in the air, and thereby the safety from aerial oxidation can be further heightened. However, the charging manner adopted in the present invention is not always limited to the foregoing ones.

The developer composition charged in the present container is suitable for the use in an automatic developing machine. In a developing system which can take full advantage of the present invention, the container filled with the present developer composition is loaded in a developing machine, the composition inside the container is poured into a replenisher tank for development or a development tank directly, the interior of the container is washed with a definite amount of water and, at the same time, the water used for washing is introduced into the replenisher tank to be utilized as the water for preparing a replenisher, and the development is carried out using the thus prepared replenisher. For washing the interior of the container with a definite amount of water, it is particularly advantageous to adopt a spray washing method. By this replenisher preparation method, the washing water is utilized effectively and the amount of waste water discharged from a processing laboratory can be reduced. For recycling spent bottles, however, it is a precondition that the bottles are free from coloration and adhesion of color stain.

The combination of the present HDPE-made bottle and color developer composition having a controlled specific gravity value enables the stabilization of the composition and ensures homogeneous dissolution free from precipitates. Thus, the container does not color itself, adhesion of color stain to the container wall does not occur, the contents easily flow from the bottle, and the container emptied of its contents can be washed with a small amount of water. From the viewpoints of recycling spent containers, saving water and reducing waste water, it is advantageous to combine the development-processing chemical in the present container with an automatic developing machine equipped with a container washing mechanism.

The development-processing system as a particularly advantageous embodiment of the present invention enables labor saving by incorporating the developer composition therein and can be highly safe from environmental and working points of view. More specifically, such a system is devised so that the seal part of a container cap is broken by a mechanism of automatically breaking the cap seal of the container as soon as the container filled with the developer composition is loaded in the developing machine and the fluid contents in the bottle is discharged smoothly from the bottle into a replenisher tank for development. Subsequently to the discharge, the interior of the container is automatically spray-washed and thereby the chemical components adhering to the container wall are washed out. The water used for washing is used for preparing the replenisher. By using the system as mentioned above, development-processing of silver halide color photographic materials can be performed.

The systems for loading such a developer composition container in an automatic developing machine are disclosed in, e.g., JP-A-6-82988 and JP-A-8-220722. According to these systems, the interior of the container is made clean by spraying washing water without using human hands, and cleaned containers can be recycled with ease. In addition, the washing water is utilized as a part of the water for dissolving the developer, so it is not discharged as waste water. The design of such a system can be realized for the first time by the foregoing developer composition embodied by the present invention which has a small volume because of its high concentration, is easy to handle and retains sufficient fluidity for a long time.

In the next place, components of the present developer composition, other than those directly relating to the aforementioned requirements for the present constitution and particularly preferred embodiments of the present invention, are illustrated.

The developer composition is an alkaline liquid of a continuous phase, which contains general color developer components in a dissolved condition. Therein, color developing agents are contained and, as mentioned above, the main component thereof comprises at least 4-amino-3-methyl-N-ethyl-N-(β-hydroxylethyl)aniline. Besides such color developing agents, 4-amino-3-methyl-N-ethyl-N-(β-methanesulfoamidoethyl)aniline or a salt thereof, or other p-phenylenediamine color developing agents may be added in small amounts as auxiliary color developing agents, if needed for increasing a development-processing speed and so on. Further, the present developer composition can be applied to the processing of the latest black-and-white photographic materials wherein couplers capable of forming black color are incorporated and black images are formed with a generally used color developer.

The working solution as a replenisher for development (or a developer obtained by further dilution thereof) is prepared by mixing the processing chemical composition with water (including the water used for washing the container) in a desired ratio at the time of use. Specifically, the developer composition is diluted so that the concentration of aromatic primary amine developing agents in the working solution is from 2 to 200 millimoles/l, preferably from 12 to 200 millimoles/l, particularly preferably from 12 to 150 millimoles/l.

As mentioned above, the present processing chemical composition contains at least one preservative selected among hydroxylamine derivatives or a small amount of sulfite ions depending on the kind of photographic materials to be processed thereby. Besides such a preservative, the present composition may contain other inorganic and organic preservatives. The term "organic preservatives" as used herein is intended to include all organic compounds capable of reducing the deterioration speed of aromatic primary amine color developing agents when they are present in processing solutions for photographic materials. In other words, organic preservatives are organic compounds functioning so as to protect color developing agents from aerial oxidation. Of such organic compounds, mono- or di-alkylhydroxylamines other than the hydroxylamine derivatives recited above, alkoxymino compounds, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds and amines of condensed ring type are particularly effective organic preservatives. Specific examples of such compounds are disclosed in, e.g., JP-A-63-4235, JP-A-63-30845, JP-A-63-21647, JP-A-63-44635, JP-A-63-53551, JP-A-63-43140, JP-A-63-56654, JP-A-63-58346, JP-A-63-43138, JP-A-63-146041, JP-A-63-44657, JP-A-63-44656, U.S. Pat. No. 3,615,503, U.S. Pat. No. 2,494,903, JP-A-52-143020 and JP-B-48-30496 (the term "JP-B" as used herein means an "examined Japanese patent publication").

As other preservatives, the present processing chemical composition may contain various kinds of metal as disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the aromatic polyhydroxy compounds as disclosed in, e.g., U.S. Pat. No. 3,746,544, if desired. In addition, alkanolamines other than the above-cited ones, e.g., triethanolamine, maybe added.

As for the other amines, the cyclic amines as disclosed in JP-A-63-239447, the amines as disclosed in JP-A-63-128340 and the amines as disclosed in JP-A-1-186939 and JP-A-1-187557 can also be added.

To the present developer composition may be added chlorine ions, if needed. Many of generally used color developers (especially developers for color print materials) range in chlorine ion concentration from $3.5\times10^{-2}$ to $1.5\times10^{-1}$ mole/l. However, the addition of chlorine ions to a replenisher is not required in many cases, as the chlorine ions are generally released to the developers as the side-product of the development. Not only the chlorine ion concentration of the replenisher but that of the processing chemical composition as the parent thereof is set so that the chlorine ion concentration in the development tank where the composition attains the running equilibrium is on a level with the foregoing concentration. The chlorine ion concentrations higher than $1.5\times10^{-1}$ mole/l retard the development to damage the processing speed and the developed color density. On the other hand, the chlorine ion concentrations lower than $3.5\times10^{-1}$ mole/l are undesirable in many cases from the viewpoint of fog prevention.

The bromide ion concentration in the developer composition is in the same situation as the chloride ion concentration. The suitable bromide ion concentration in a color developer is of the order of $1–5\times10^{-3}$ mole/l in the case of processing photograph-taking materials, and it is not higher than $1.0\times10^{-3}$ mole/l in the case of processing print materials. The bromide ions can be added to the processing chemical composition so that they are in the foregoing range, if needed.

Examples of a material for supplying chlorine ions to the developer composition include sodium chloride, potassium chloride, ammonium chloride, lithium chloride, nickel chloride, magnesium chloride and calcium chloride. Of these chlorides, sodium chloride and potassium chloride are preferred over the others.

Examples of a material for bromide ion supply include sodium bromide, potassium bromide, ammonium bromide, lithium bromide, calcium bromide, manganese bromide, nickel bromide, cerium bromide and thallium bromide. Of these bromides, potassium bromide and sodium bromide are preferred over the others.

The pH of the present developer composition is mentioned above, and the color developer or its replenisher prepared therefrom is adjusted so as to have a pH value of at least 9.5, preferably from10.0 to12.0, more preferably from 10.1 to 11.5.

For maintaining the pH constant, it is desirable to use various kinds of pH buffers. Examples of a pH buffer usable therein include carbonates, phosphates, borates, tetraborates, hydroxybenzoates, glycine salts, N-N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates have advantages of being excellent in buffering ability in the pH range 9.5 or higher, having no adverse effects upon photographic properties (e.g., fog) and being inexpensive. Therefore, it is desirable to use these buffering agents so as to meet the present specific gravity range.

Examples of such a pH buffering agent include sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, these compounds should not be construed as limiting the scope of the present invention in any way. In particular, potassium carbonate is preferred over the others, as it has an advantage of effectively heightening the specific gravity value without causing precipitation due to its high solubility.

The pH buffering agents are added to the composition in such an amount that the their concentration in the color development replenisher prepared by diluting the composition is at least 0.01–2 mole/l, particularly from 0.1 to 0.5 mle/l.

To the present developer composition, other color developer components, e.g., wide variety of chelating agents which can function as suspending agents for calcium and magnesium or as stability improver for color developers can be added. Examples of such a chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, ethylenediamine-N,N-disuccinic acid, N,N-di(carboxylato)-L-aspartic acid, β-alaninedisuccinic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxybenzene-4,6-disulfonic acid.

These chelating agents may be used as a mixture of two or more thereof, if needed.

They can be added in an amount sufficient to block metal ions in the color developer. Specifically, the suitable amount added is of the order of 0.1–10 g/l.

To the present developer composition, any of known development accelerators can be added, if needed.

Examples of a development accelerator which can be added, if needed, include the thioether compounds disclosed in JP-B-37-16088, JP-B-37-5987, JP-B-38-7826, JP-B-44-12380, JP-B-45-9019 and U.S. Pat. No. 3,813,247, the p-phenylenediamine compounds disclosed in JP-A-52-49829 and JP-A-50-15554, the quaternary ammonium salts disclosed in JP-A-50-137726, JP-B-44-30074, JP-A-56-156826 and JP-A-52-43429, the amine compounds disclosed in U.S. Pat. Nos. 2,494,903, 3,128,182, 4,230,796 and 3,253,919, JP-B-41-11431 and U.S. Pat. Nos. 2,482,546, 2,596,926 and 3,582,346, the polyalkylene oxides disclosed in JP-B-37-16088, JP-B-42-25201, U.S. Pat. Nos. 3,128,183, JP-B-41-11431, JP-B-42-23883 and U.S. Pat. Nos. 3,532,501, 1-phenyl-3-pyrazolidones and imidazoles.

To the present developer composition, any of known antifoggants can be added, if needed. As the antifoggants can be used the halides of alkali metals, such as sodium chloride, potassium bromide and potassium iodide, and organic antifoggants. Representative examples of an organic antifoggant include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Also, various kinds of surfactants, such as alkylsulfonic acids, arylsulfonic acids, aliphatic carboxylic acids and aromatic carboxylic acids, may be added, if desired.

The foregoing is a detailed explanation of the present color developer composition and the color development replenisher and color developer prepared therefrom.

The processing conditions applied to the present invention, including the color development temperature, time and replenishment rate, are mentioned below. In cases where the photographic materials processed are color negative films and color reversal films, the development temperature is in the range of 20–55° C., preferably 30–55° C., more preferably 38–45°. The development-processing time is from 20 seconds to 6 minutes. The range of 30 to 200 seconds is suitable for the development-processing time in the case of color negative films. In the case of color reversal films, on the other hand, the suitable development time is from 2 to 6 minutes. Although it is desirable to lower a replenishment rate in terms of reduction in environmental load, the suitable range of the replenishment rate is from 100 to 1,200 ml, preferably from 200 to 500 ml, particularly preferably from 240 to 400 ml, per $m^2$ of photographic material.

In cases where the photographic materials processed are color print materials, on the other hand, the development temperature is in the range of 30–55° C., preferably 35–55° C., more preferably 38–45° C. The development processing time is from 5 to 90 seconds, preferably from 14 to 60 seconds. It is desirable that the replenishment rate be lowered, but the suitable range thereof is from 15 to 600 ml, preferably from 15 to 120 ml, particularly preferably from 30 to 60 ml, per $m^2$ of photographic material.

In embodying the present invention, the developing step using the color developer prepared from the present development processing chemical composition is succeeded by a desilvering step using a bleaching bath-or bleach-fix bath.

In the bleaching bath or bleach-fix bath, known bleaching agents can be used. In particular, Fe(III) complex salts of organic acids (e.g., complex salts of aminopolycarboxylic acids), organic acids such as citric acid, tartaric acid and malic acid, persulfates and hydrogen peroxide can be used to advantage.

Of these compounds, Fe(III) complex salts of organic acids are preferred over the others from the viewpoints of rapid processing and prevention of environmental pollution. Examples of an aminopolycarboxylic acid or its salt useful for the formation of Fe(III) complex salts of organic acids include biodegrading ethylenediaminedisuccinic acid (SS isomer), N-(2-carboxylatoethyl) -L-aspartic acid, β-alaninediacetic acid, methyldiiminoacetic acid, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycoletherdiaminetetraacetic acid. These compounds may be any of sodium, potassium, lithium and ammonium salts. Of these compounds, ethylenediaminedisuccinic acid (SS isomer), N-(2-carboxylatoethyl)-L-aspartic acid, β-alaninediacetic acid, ethylenediaminetetraacetic acid, 1,3-diaminopropanetetraacetic acid and methyliminodiacetic acid are preferred over the others, as their Fe(III) complex salts ensure good photographic properties. These ferric ion complex salts may be used as they form complex salts, br may be formed in a solution by the use of ferric salts, such as ferric sulfate, ferric chloride, ferric nitrate, ammonium ferric sulfate and ferric phosphate, and chelating agents such as aminopolycarboxylic acids. In addition, chelating agents may be used in excess, compared with the amount required for the formation of ferric complex salts.

The concentration of Fe(III)-organic acid complex salt in a replenisher is from 0.01 to 1.0 mole/l, preferably from 0.05 to 0.50 mole/l, more preferably from 0.10 to 0.50 mole/l. The bleaching chemical composition is designed so that the replenisher prepared therefrom by dilution has the complex salt concentration in the aforesaid range.

The bleaching time ranges generally from 10 seconds to 6 minutes and 30 seconds, preferably from 30 seconds to 4 minutes and 30 seconds, when the photographic materials processed are color negative films or color reversal films, and it is from 10 seconds to 1 minute in the case of bleach processing of color print materials.

The fixing agent used in a bleach-fix or fixing bath may be any of known fixing agents. Specifically, such fixing agents are water-soluble silver halide solvents, with examples including thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and thioureas. These silver halide solvents maybe used alone, or as a mixture of two or more thereof. Also, a special bleach-fix bath comprising the combination of the fixing agent as disclosed in JP-A-55-155354 with a large amount of halide, such as potassium iodide, can be used. In the present invention, it is desirable to use thiosulfates, especially ammonium thiosulfate. The suitable concentration of a fixing agent is from 0.3 to 2 moles/l, preferably from 0.5 to 1.0 mole/l.

The suitable pH of a bleach-fix or fixing bath relating to the present invention is in the range of 3 to 8, particularly preferably 4 to 7. When the pH is lower than this range, the desilvering characteristics are enhanced, but the deterioration of the bath is speeded up and the conversion of cyan dyes into their leuco bodies is promoted; while, when the pH is higher than this range, the desilvering is retarded and stains tend to generate.

The pH range of a bleaching bath used in the present invention is not higher than 8, preferably from 2 to 7, particularly preferably from 2 to 6. When the pH is lower than this range, the deterioration of the bath is speeded up and the conversion of cyan dyes into their leuco bodies is promoted; while, when the pH is higher than this range, the desilvering is retarded and stains tend to generate.

In order to adjust the pH, hydrochloric acid, sulfuric acid, nitric acid, hydrogen carbonates, ammonia, potassium hydroxide, sodium hydroxide, sodium carbonate, potassium carbonate and so on can be added as the need arises.

The bleach-fix bath can further contain various kinds of brightening agents, antifoaming agents or surfactants, polyvinyl pyrrolidone, and organic solvents such as methanol and the like.

It is desirable that the bleach-fix bath and the fixing bath contain, as preservatives, sulfite ion-releasing compound, such as sulfited (e.g., sodium sulfite, potassium sulfite, ammonium sulfite), hydrogen sulfited (e.g., ammonium hydrogen sulfite, sodium hydrogen sulfite, potassium hydrogen sulfite) and metabisulfites (e.g., potassium metabisulfite, sodium metabisulfite, ammonium metabisulfite), arylsulfinic acids, such as p-toluenesulfinic acid and m-carboxybenzenesulfinic acid, and so on. These compounds are added in a concentration of from about 0.02 to about 1.0 mole per liter, based on the sulfite ion or sulfinic acid ion.

Besides the above-recited compounds, ascorbic acid, a carbonyl-bisulfite adduct or a carbonyl compound may be added as another preservative.

Further, buffers, chelating agents, antimolds and so on may be added, if needed.

The processing time in the bleach-fix step relating to the present invention is from 5 to 240 seconds, preferably from 10 to 60 seconds. The processing temperature therein is from 25° C. to 60° C., preferably from 30° to 50° C. And the replenishment rate is from 20 ml to 250 ml, preferably from 30 ml to 100 ml, particularly preferably from 15 ml to 60 ml, per $m^2$ of photographic material.

The desilvering step, such as fixing or bleach-fix step, is generally followed by a washing step or stabilizing step as a washing step substitute, or stabilization processing, or both of them.

The volume of washing water required in the washing step or stabilizing step as a washing step substitute (hereinafter referred to as the washing step by the lump) can be determined variously depending on the characteristics of the photographic materials to be processed (e.g., on what kinds of couplers are incorporated therein), the end-use purpose of the photographic materials to be processed, the temperature of the washing water, the number of washing tanks (the number of stages), and other various conditions. Of these conditions, the relation between the number of washing tanks and the volume of washing water in the multistage counter current process can be determined according to the methods described in *Journal of the Society of Motion Picture and Television Engineers*, volume 64, pages 248–253 (May, 1955). In general, the desirable number of stages in the multistage counter current process is from 3 to 15, especially from 3 to 10.

According to the multistage counter current process, the volume of washing water can be sharply reduced. However, the process has a problem that bacteria which have propagated themselves in the tanks because of an increase in the staying time of the water in the tanks produce a suspended matter, and the suspended matter produced adheres to photographic materials processed therein. As a measure for solving this problem, the method of lowering calcium and magnesium concentrations, as disclosed in JP-A-62-288838, can be employed to great advantage. Also, it is effective to use germicides, e.g., the isothiazolone and thiabendazole compounds disclosed in JP-A-57-8542, chlorine-containing germicides such as sodium salt of chlorinated isocyanuric acid disclosed in JP-A-61-120145, the benzotriazoles disclosed in JP-A-61-267761, copper ion and other bactericides described in Hiroshi Horiguchi, *Bohkin Bohbai no Kagaku* (which means "Antibacterial and Moldproof Chemistry), Sankyo shuppan (1986); *Biseibutu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutu Kai in 1982; and *Bohkin-Bohbaizai Jiten* (which means "Encyclopedia of Antibacteria and Antimolds"), compiled by Nippon Bohkin Bohbai Gakkai.

In the washing water, surfactants as draining agents and chelating agents represented by DETA as water softeners can further be used.

Subsequently to the above-described washing step, or directly after the desilvering step without undergoing any washing step, photographic materials can be processed with a stabilizer. To the stabilizer, compounds having an image stabilizing function are added, with examples including aldehyde series compounds represented by formaldehyde, buffers for adjusting the processed films to a pH value suitable for stabilization of dyes and ammonium compounds. Further, aldehydes capable of deactivating the residual magenta couplers to prevent the discoloration of dyes and the generation of stains, such as formaldehyde, acetaldehyde and pyruvinaldehyde, the methylol compounds and hexamethylenetetramine disclosed in U.S. Pat. No. 4,786,583, the hexahydrotriazines disclosed in JP-A-2-153348, the formaldehyde-bisulfite adducts disclosed in U.S. Pat. No. 4,921,779, and azolylmethylamines disclosed in EP-A-50460 and EP-A-519190 can be added to the stabilizer. Also, the foregoing various germicides and antimolds can be added to the stabilizing bath in order to prevent bacteria from propagating themselves therein and to keep the processed photographic materials from getting moldy.

Furthermore, surfactants, brightening agents and hardeners can be added, too. In a case where the stabilization step follows directly the desilvering step without going through any washing step in the photographic processing relating to the present invention, all known methods disclosed in JP-A-57-8534, JP-A-58-14834 and JP-A-60-220345, and so on can be applied.

In another preferred embodiment, chelating agents such as 1-hydroxy-1,1-diphosphonic acid, ethylenediaminetetramethylenephosphonic acid and the like, and magnesium and bismuth compounds are used in the stabilizer.

Also, the so-called rinsing solution can be used as a substitute for washing water or stabilizer after the desilvering processing.

The suitable pH of the washing or stabilizing bath ranges from 4 to 10, preferably from 5 to 8. The temperature, though it can be chosen variously depending on the characteristics and the intended use of photographic materials to be processed, is generally from 20° C. to 50° C., preferably from 25° C. to 45° C.

The washing or stabilization step is followed by a drying step. From the standpoint of reducing the quantity of water brought into image-formed films, it is possible to speed up the drying step by absorbing the water on the image-formed films by means of a squeegee roller, cloth or the like just after the washing step finishes. As for the means to raise the drying speed on the dryer side, it is only natural that the drying temperature is made high, or it is possible to modify the blowing nozzle shape so as to strengthen the drying wind. Further, as disclosed in JP-A-3-157650, the drying step can be quickened by controlling the angle at which the drying wind is blowing onto the photographic material, or by properly choosing the way of removing the wind discharged.

The color photographic materials as the object for application of the development-processing method using the present color developer composition are illustrated below.

The present method can be applied to color photographic materials in general, including those for photograph-taking and those for printing. More specifically, the present method is applicable to any of color negative films, color reversal films and color photographic printing papers. Therein, it doesn't matter whether the color photographic materials are for general or professional users, or motion picture use.

The silver halide used in photographic materials relating to the present invention can be any of silver chloride, silver bromide, silver chlorobromide, silver iodobromide and silver chloroiodobromide. Of these silver halides, however, silver iodobromide is generally used in photographic materials for photograph-taking use, such as color negative films; while silver chlorobromide having a chloride content of at least 98 mole % and substantially no iodide content as well as silver chloride is favorably used in photographic printing materials, such as color photographic printing paper.

Such silver halide as recited above is prepared using known emulsion-making techniques so as to have a grain structure desirable for its intended purpose, e.g., a tabular structure, a double structure, a multiple structure or a structure having an epitaxial growth part.

These silver halide photographic emulsions usable in the present invention can be prepared using the methods described in, e.g., *Research Disclosure* (hereinafter abbreviated as "RD"), No. 17643 (December, 1978), pages 22–23, entitled "I. Emulsion Preparation and Types"; ibid., No.18716 (November, 1979), page 648; ibid., No. 307105 (November, 19899), pages 863–865; P. Glafkides, *Chemie et Phisique Photographique*, Paul Montel, 1967; G. F. Duffin, *Photographic Emulsion Chemistry*, Focal Press (1966); and V. L. Zelikman et al., *Making and Coating Photographic Emulsion*, Focal Press (1964).

In the silver halide photographic materials to which the present invention is applicable, hitherto known constituent materials for photography and additives can be used.

As for the support, a transparent film support, such as polyethylene terephthalate film, polyethylene naphthalate film or cellulose triacetate film, and a reflection type of support having a light-reflecting layer provided on polyethylene terephthalate film, polyethylene naphthalate film, cellulose triacetate film, paper or the like are desirable for attaining the purposes of the present invention. For the support of reflection type, it is desirable to have a laminate of two or more polyethylene or polyester layers, and that contain a white pigment, such as titanium oxide, in at least one of such waterproof resin layers (laminated layers).

Further, it is desired to incorporate a brightening agent into the aforementioned waterproof resin layer. On the other hand, the brightening agent may be dispersed in hydrophilic colloid layers of the photographic materials. Therein, the brightening agents of benzoxazole type, coumarin type and pyrazoline type are used to advantage. Of these brightening agents, the brightening agents of benzoxazolylnaphthalene and benzoxazolylstilbene types are preferred in particular. The amount of a brightening agent used, though has no particular limitation, is desirably in the range 1–100 mg/m$^2$. When the brightening agent is mixed with waterproof resin, the proportion thereof is preferably from 0.005 to 3 weight %, more preferably from 0.001 to 0.5 weight %, to the resin.

In the photographic materials relating to the present invention, it is desirable for the purpose of elevating the image sharpness and so on that the dyes capable of discolored by processing (especially oxonol dyes) as disclosed in European Patent 0,337,490 A2 be added to hydrophilic colloid layers in such an amount as to provide an optical reflection density of at least 0.70 at the wavelength of 680 nm and the titanium oxide treated with a di- to tetrahydric alcohol (e.g., trimethylolethane) be incorporated in a waterproof resin layer of the support in a proportion of at least 12 weight (preferably at least 14 weight %).

To the photographic materials relating to the-present invention, it is desirable to further add the antimolds as disclosed in JP-a-63-271247 for the purpose of preventing various kinds of molds and bacteria from propagating themselves in the hydrophilic colloid layers to lower image quality.

The photographic materials relating to the present invention may be exposed to either visible or infrared light. For the exposure, not only low illumination intensity exposure but also high illumination intensity short-duration exposure can be employed. In the latter case, it is desirable to utilize a laser scanning exposure system wherein the exposure time per picture element is shorter than $10^{-4}$ second.

As for the silver halide emulsions and other ingredients (such as additives and so on) and the photographic constituent layers (including their order of arrangement), and the methods adopted for processing these photographic materials and the additives used therein, those disclosed in European Patent 0,355,660 A2, JP-A-2-33144 and JP-A-62-215272, or those shown in the following Table 1 can be preferably applied to the photographic materials relating to the present invention.

TABLE 1

| Kinds of Additives | RD 17643 | RD18716 | RD307105 |
|---|---|---|---|
| 1. Chemical sensitizer | p. 23 | p. 648, right column | p. 866 |
| 2. Sensitivity increasing agent | | p. 648, right column | |
| 3. Spectral sensitizer and Supersensitizer | pp. 23–24 | p. 648, right column, to p. 649, right column | pp.866–868 |
| 4. Brightening agent | p. 24 | p. 647, right column | p. 868 |
| 5. Light absorbent, Filter dye, UV absorbent | pp. 25–26 | p. 649, right column, to p. 650, left column | p. 873 |
| 6. Binder | p. 26 | p. 651, left column | pp.873–874 |
| 7. Plasticizer, Lubricant | p. 27 | p. 650, right column | p. 876 |
| 8. Coating aid, Surfactant | pp.26–27 | p. 650, right column | pp.875–876 |
| 9. Antistatic agent | p. 27 | p. 650, right column | pp.876–877 |
| 10. Matting agent | | | pp. 878–879 |

In the photographic materials to which the present invention is applied, it is desirable that the compounds for improving color image keeping quality as disclosed in European Patent 0,277,589 A2 be used in combination with pyrazoloazole couplers, pyrrolotriazole couplers or yellow couplers of acylacetamide type.

As for the cyan couplers, besides the phenol couplers and naphthol couplers described in the references cited in the foregoing table, the cyan couplers disclosed in JP-A-2-33144, European Patent 0,333,185 A2, JP-A-64-32260, European Patent 0,456,226 A1, European Patent 0,484,909, European Patent 0,488,248 and European Patent 0,491,197 A1 may be employed.

In particular, it is effective to apply the present invention to the development-processing of silver halide color photographic materials containing as cyan couplers the pyrrolotrizole derivatives disclosed in, e.g., JP-A-5-150423, JP-A-5-255333, JP-A-5-202004, JP-A-7-048376 and JP-A-9-189988. Of course, the present method can be applied to photographic materials containing cyan couplers other than the pyrrolotriazole couplers.

As for the magenta couplers, not only the 5-pyrazolone magenta couplers as described in the references cited in the foregoing table but also the magenta couplers disclosed in WO 92/18901, WO 92/18902 and WO 92/18903 are used to advantage. Besides these 5-pyrazolone magenta couplers, known pyrazoloazole couplers can be used for the present invention. In particular, the pyrazoloazole couplers disclosed in JP-A-61-65245, JP-A-61-65246, JP-A-61-14254, EP-A-226849 and EP-A-294785 are preferred over the others in terms of hue, image stability and color developability.

As for the yellow couplers, known acylacetanilide couplers are used to advantage. In particular, the couplers disclosed, e.g., in EP-A-0447969, JP-A-5-107701, JP-A-5-113642, EP-A-0482552 and EP-A-0524540 are preferred over the others.

The present invention can be applied to general-purpose color negative films for general use or motion picture use. Further, the present invention is suitable for lens-attached film units disclosed in JP-B-2-32615 and JP-B-U-3-39784 (the term "JP-B-U" as used herein means an "examined Japanese utility model publication). The supports suitable for the present invention are those described in the above-cited RD No. 17643, at page 28, RD No. 18716, from page 647, right column, to page 648, left column, and RD No. 307105, at page 879. In particular, a polyester support is used to advantage.

The application of the present invention to color negative films, which are each provided with a magnetic recording layer, is a preferable case. The magnetic recording layers usable in the present invention are described below. The term "magnetic recording layer" as used herein refers to the layer formed by coating on a support an aqueous or oily coating composition in which magnetic particles and binder are dispersed. Examples of magnetic particles usable herein include ferromagnetic iron oxides, such as $\gamma$-$Fe_2O_3$, Co-coated $\gamma$-$Fe_2O_3$, Co-coated magnetite, Co-containing magnetite, ferromagnetic chromium dioxide, ferromagnetic metals, ferromagnetic alloys, and the Ba, Sr, Pb and Ca ferrites of hexagonal system. Of these ferromagnetic substances, Co-coated ferromagnetic iron oxides, such as Co-coated $\gamma$-$Fe_2O_3$, are preferred over the others.

The binders usable for dispersion of magnetic particles are the resins disclosed in JP-A-4-219569, including thermoplastic resins, thermosetting resins, radiation curable resins, reactive resins, acid-, alkali or bio-decomposable polymers, natural polymers (e.g., cellulose derivatives, saccharide derivatives) and mixtures of two or more thereof. The Tg values of the resins recited above range from −40° C. to 300° C., and the weight average molecular weight thereof ranges from $0.2\times10^4$ to $100\times10^4$. More specifically, vinyl copolymers, cellulose derivatives, such as cellulose diacetate, cellulose triacetate, cellulose acetate propionate, cellulose acetate butyrate and cellulose tripropionate, acrylic resins and polyvinyl acetal resins can be recited. Also, gelatin can be used to advantage.

The magnetic recording layer may be designed so as to have diverse functions of improving lubricity, controlling the tendency toward curling, preventing static electricity, preventing adhesion, abrading heads and so on, or may be provided with another functional layer having the aforementioned functions. Therein, it is desirable to incorporate an abrasive comprising at least one kind of aspherical inorganic grains having Mohs hardness of at least 5. As examples of a suitable component of aspherical inorganic grains, mention may be made of fine powders of oxides such as aluminum oxide, chromium oxide, silicon dioxide and titanium dioxide, carbides such as silicon carbide and titanium carbide, and diamond. Such an abrasive may have a surface treated with a silane coupling agent or a titanium coupling agent. Those grains may be added to the magnetic recording layer, or spread over the magnetic recording layer (e.g., as a protective layer or a lubricant layer). The binder used in the latter case may be any of the binders as recited above, preferably the same binder as used in the magnetic recording layer. The photographic materials having magnetic recording layers are disclosed in U.S. Pat. Nos. 5,336,589, 5,250,404 and 5,229,259, 5,215,874, and European Patent 0,466,130.

In these photographic materials as an object for the application of the present invention, it is desirable to use antistatic agents. For example, carboxylic acids and salts thereof, polymers containing sulfonates, cationic polymers and ionic surface active compounds can be used as such antistatic agents.

Further, it is desirable that the photographic materials have slippability. Preferably, the slipping agent-containing layer is provided on both the light-sensitive layer side and the backing layer side. The suitable slippability is in the range of 0.25 to 0.01 in terms of kinematic friction coefficient, and polyorganosiloxanes, higher fatty acid amides, metal salts of higher fatty acids and higher fatty acid esters of higher alcohols are preferably used as slipping agent.

Also, it is desirable that a matting agent be present in the photographic materials. There may be the matting agent on either the emulsion side or the back side. However, it is especially desirable to add the matting agent to the outermost layer on the emulsion side. The matting agent may be soluble or insoluble in processing solutions, but the combined use of soluble and insoluble matting agents is preferred. For instance, polymethylmethacrylate particles, methylmethacrylate/methacrylic acid (9/1 or 5/5 by mole) copolymer particles, polystyrene particles and colloidal silica can be preferably used as matting agent.

The embodiments and effects of the present invention will now be illustrated below in greater detail by reference to the following examples, but it should be understood that these examples are not to be construed as limiting the scope of the invention in any way.

EXAMPLE 1

1. Container:

Molding of Container;

The plastic bottle as shown in FIG. 1 was used as a container of a development-processing chemical composition. More specifically, the bottle used was constituted of the body part made by blow molding and the cap part made by injection molding.

Shape of Container;

The body of the bottle was a quadratic prism as shown in FIG. 1, which had outside size of 77 mm×7 mm×301 mm (height). The circular mouth part with a 30 mm diameter (ϕ) was provided on the upper part of the prism gathered up (drawn) so that the upper end of the prism fitted the mouth. The internal volume of the bottle was 1,400 ml, and the amount of liquid charged therein was 1,300 ml.

Material;

For the body of the bottle, high-density polyethylene B161 (with a density of 0.966 and a melt index of 1.35 g/10 min, produced by Asahi Chemical Industry Co., Ltd.) was used.

For the cap, high-density polyethylene J751A (with a density of 0.952 and a melt index of 1.30 g/10 min, produced by Asahi Chemical Industry Co., Ltd.).

(Additionally, the melt index values were determined using ASTM D1238 under the applied pressure of 2.16 kg.)

Average Weight per Unit Surface area of Container;

Five bottles (B-1 to B-5) set forth in the following Table 2 were used, which were made so that they, though had the same shape and the same total external surface area of 805 $cm^2$ in the body part shown in FIG. 1, were different from one another in average weight per unit surface area by changing their weight values. Additionally, the body weight of each bottle was measured after the part not corresponding to the body was cut off the bottle.

TABLE 2

| Container number | Weight | Average weight per unit surface area | Note |
|---|---|---|---|
| B-1 | 30 g | 0.037 g/$cm^2$ | comparison |
| B-2 | 35 g | 0.043 g/$cm^2$ | invention |
| B-3 | 50 g | 0.062 g/$cm^2$ | invention |
| B-4 | 70 g | 0.087 g/$cm^2$ | invention |
| B-5 | 80 g | 0.099 g/$cm^2$ | comparison |

2. Preparation of Color Developer Composition:

A color developer composition of the following formula was prepared.

| (1) Standard Formula of Color developer composition | |
|---|---|
| Diethylenetriaminepetaacetic acid | 3.5 g |
| Potassium hydroxide | 2.75 g |
| Sodium sulfite | 0.048 mole |
| Disodium N,N-bis(sulfonatoethyl)-hydroxylamine | 6.0 g |
| 4-Amino-3-methyl-N-ethyl-N-(β-hydroxyethyl) aniline sulfate | 6.9 g |
| Potassium carbonate | 40.4 g |
| Water to make | 1 liter |
| Specific gravity (25° C.) | 1.043 |
| pH adjusted to | 10.1 |

(2) Specific Gravity Values of Color Developer Compositions used for Testing:

Color developer compositions D-1 to D-6 set forth in the following Table 3 were prepared by variously changing the volume of water in the foregoing standard formula (to make the total volume of the composition 1 liter).

TABLE 3

| Sample Number | Volume of water added* | Specific gravity | Note |
|---|---|---|---|
| D-1 | 1000 ml | 1.043 | comparison |
| D-2 | 850 ml | 1.051 | invention |
| D-3 | 440 ml | 1.100 | invention |
| D-4 | 300 ml | 1.147 | invention |
| D-5 | 250 ml | 1.176 | invention |
| D-6 | 220 ml | 1.198 | comparison |

*The total volume of each composition after dissolving the ingredients of the foregoing standard formula in water Each of the six kinds of color developer compositions, D-1 to D-6 illustrated in the above paragraph 2, D-1 to D-6, was charged in 1,300 ml portions into five separate HDPE bottles, B-1 to B-5 mentioned in the foregoing paragraph 1, and the mouth part of each bottle was sealed by welding a polyethylene sheet. Thus, 30 (6×5) kinds of composition-charged bottle samples were obtained.

3. Test on Storage Stability for Color Developer Compositions:

Each of the composition samples prepared was stored for 8 weeks in a thermo-hygostatic room kept at 40° C. and 60% RH. After 8 weeks' storage, the composition inside each bottle was discharged, and then 50 ml of 25° C. water was poured into the bottle. The bottle was capped and shaken vertically, and then the water in the bottle was discharged. This operation for washing the bottle was further repeated two times. Then, the resultant bottle was examined as to whether or not it had precipitates adhering to the inside thereof, and the bottle's state of coloration was evaluated by visual observation from the outside. The composition and the washing water discharged were used for preparing a test developer or a test replenisher for development.

4. Results and Evaluation Methods therefor:

The evaluation results of aging tests run on the 30 samples are shown in the following Table 4. Additionally, the combinations of D-2 to D-5 and B-2 to B-4 set forth in the middle part of the table are within the scope of the present invention.

The marks ○, Δ and X in Table 4 mean the evaluation criteria mentioned below:

(Evaluation of Colored Matter Adhesion to Inside Wall of Bottle)

○: No colored matter adhered to the inside wall

Δ: A slight colored matter adhered to part of the inside wall

X: A colored matter adhered to the inside wall almost all over (Evaluation of Bottle Coloration observed from Outside)

○: Substantially no coloration was observed

Δ: Slight coloration was observed

X: Clear coloration was observed

In Table 4, the evaluation of colored matter adhesion is on the left side of each column, and the evaluation of bottle's state of coloration is on the right side of each column.

TABLE 4

| | Composition | | | | | |
|---|---|---|---|---|---|---|
| Bottle | D-1 | D-2 | D-3 | D-4 | D-5 | D-6 |
| B-1 | XX | XX | ΔX | XX | XX | XX |
| B-2 | XX | ΔΔ | Δ○ | ΔΔ | ΔΔ | XX |
| B-3 | XX | Δ○ | ○○ | ○Δ | ΔΔ | ΔX |
| B-4 | XX | ΔΔ | ○Δ | ○Δ | ΔΔ | ΔX |
| B-5 | ΔX | ΔX | ○X | ○X | ΔX | ΔX |

Each of the samples in which both the specific gravity of each composition and the condition of each bottle were within the scope of the present invention (specifically, the average weight of each bottle per unit surface area was in the range of 0.043 to 0.087 and the specific gravity of each composition was from 1.051 to 1.176) had no or slight adhesion of colored matter to the bottle, and showed no or slight coloration in the bottle. In particular, the combination of the bottle condition B-3 and the specific gravity value of D-3 was preferred over the others. As for the comparative samples, on the other hand, some of them had either colored matter adhesion to the bottle or coloration in the bottle on the allowable level, but none of them were successful in satisfying both characteristics.

EXAMPLE 2

The effect of a sulfite as a additive component was examined in this example. Specifically, the combination of the bottle condition B-3 and the specific gravity value D-3 that showed the best result in Example 1 was selected, and the sulfite ion concentration therein was changed to those as shown in the following Table 5. The thus prepared samples each underwent the same tests as in Example 1.

The results obtained are shown in Table 5. The evaluation criteria adopted in Table 5 and the way of showing the results on the column are the same in Table 4.

TABLE 5

| Sample Number | Sulfite ion concentration | Results | Note |
|---|---|---|---|
| D-31 | 0.00 mole/l | ΔΔ | invention |
| D-32 | 0.01 mole/l | ○○ | preferred embodiment of invention |
| D-33 | 0.048 mole/l | ○○ | preferred embodiment of invention |
| D-34 | 0.096 mole/l | ○○ | preferred embodiment of invention |
| D-35 | 0.192 mole/l | ○Δ | preferred embodiment of invention |
| D-36 | 0.24 mole/l | ΔΔ | invention |

Samples D-32 to D-35 having their respective sulfite concentrations in the preferred range of the present invention achieved satisfactory results or results on an allowable level with respect to the evaluation of both colored matter adhesion to the bottle and coloration in the bottle. The sample D-31 having a lower sulfite concentration and the sample D-36 having a higher sulfite concentration failed in wholly satisfying both of the characteristics.

EXAMPLE 3

The influences of the density and melt index of HDPE used as material for bottles were investigated in this example. The test bottles were made from HDPE materials different in density and melt index as shown in Table 6. In making each bottle, the average weight of the bottle per unit surface area was adjusted to the same value as the bottle sample B-3 of Example 1, namely 0.062. Further, the Composition D-3 of Example 1 (density: 1.100) was selected as the composition charged into each test bottle. The thus prepared samples underwent the same tests as in Example 1.

The results obtained are shown in Table 6. The evaluation criteria adopted in Table 6 and the way of showing the results on the column are the same in Table 4.

TABLE 6

| Sample number | PE density | Melt index* | Results | Note |
|---|---|---|---|---|
| B-31 | 0.922 | 1.5 | XX | comparison |
| B-32 | 0.922 | 4.5 | XX | comparison |
| B-33 | 0.959 | 0.2 | Δ○ | invention |
| B-34 | 0.951 | 0.3 | ○○ | invention |
| B-35 | 0.966 | 1.35 | ○○ | invention |
| B-36 | 0.966 | 5.0 | ○○ | invention |
| B-37 | 0.953 | 7.0 | ○Δ | invention |

*Unit of melt index: g/10 min, applied pressure: 1.16 kg.

The materials for the comparative bottles B-31 and B-32 were low-density polyethylene (LDPE), and they both had their melt index values in the preferred range of the present invention. For these bottles, however, both the adhesion of colored matter to the bottle wall and the coloration in the bottle were observed. On the other hand, somewhat adhesion of colored matter to the bottle wall was observed for the bottle sample B-33 having the melt index value lower than the lower limit of the preferred range of the present invention, though having the density in the range of the present invention. For the bottle samples B-34, B-35 and B-36 having both density and melt index values in the preferred ranges of the present invention, neither colored matter adhesion nor coloration in the bottle was observed, and satisfactory results were obtained. The bottle sample B-37 having the melt index value at the upper limit of the preferred range of the present invention was on an allowable level, but inferior in bottle's state of coloration.

For molding bottles with high accuracy by blow molding, particularly injection blow molding, great melt index values are disadvantageous. This is because materials having great melt index values are highly fluidized by thermal fusion. In this respect, the melt index range suitable for the present invention is 7 or below, preferably 5 or below.

ADVANTAGES OF THE INVENTION

By controlling the specific gravity value of a color developer composition, the average weight per unit surface area of the bottle in which the composition is charged, and further the density and melt index values of HDPE used as a material for the bottle to their respectively proper ranges, adhesion of colored matter to the bottle can be prevented, the bottle itself does not suffer coloration, and the composition can be stored stably in the bottle. Moreover, the bottles used can be recycled. With respect to the workability in the developing step, on the other hand, the replenisher can be prepared simply from the processing chemical composition, and the composition-charged bottle can be handled with ease, and the development-processing can be performed easily by loading the composition-charged bottle in an automatic developing machine without complicated operations.

What is claimed is:

1. A color developer composition for photography comprising at least one color developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl)aniline and salts thereof, wherein the composition has a specific gravity ranging from 1.05 to 1.18, and is kept in a container comprising a plastic material consisting of high-density polyethylene, the container having an average weight per unit surface area of from 0.04 to 0.09 g/cm$^2$.

2. The color developer composition according to claim 1, which is used for preparing a color development replenisher.

3. The color developer composition according to claim 1, further comprising a sulfite in an amount of from 0.01 to 0.20 mole/l.

4. The color developer composition according to claim 1, wherein the high-density polyethylene is polyethylene having a melt index of from 0.3 to 7.0 g/10 min and a density of from 0.951 to 0.969.

5. The color developer composition according to claim 1, wherein the container consists of a layer.

6. The color developer composition according to claim 1, wherein the container consists of high-density polyethylene.

7. The color developer composition according to claim 1, wherein the container consists of high-density polyethylene and an additive.

8. A container containing a color developer composition for photography, the composition comprising at least one color developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl)aniline and salts thereof, wherein the composition has a specific gravity ranging from 1.05 to 1.18, and the container comprises a plastic material consisting of high-density polyethylene, the container having an average weight per unit surface area of from 0.04 to 0.09 g/cm$^2$.

9. The container according to claim 8, wherein the composition is used for preparing a color development replenisher.

10. The container according to claim 8, wherein the composition further comprises a sulfite in an amount of from 0.01 to 0.20 mole/l.

11. The container according to claim 8, wherein the high-density polyethylene is polyethylene having a melt index of from 0.3 to 7.0 g/l0min and a density of from 0.951 to 0.969.

12. The container according to claim 8, which consists of one layer.

13. The container according to claim 8, which consists of high-density polyethylene.

14. The container according to claim 8, which consists of high-density polyethylene and an additive.

15. A development-processing method comprising using an automatic processor replenished with a replenisher from a container containing a color developer composition for photography, the composition comprising at least one color developing agent selected from the group consisting of 4-amino-3-methyl-N-ethyl-N-(β-hydroxyethyl)aniline, 4-amino-3-methyl-N-ethyl-N-(β-hydroxypropyl)aniline, 4-amino-3-methyl-N-ethyl-N-(β-hydroxybutyl)aniline and salts thereof, wherein the composition has a specific gravity ranging from 1.05 to 1.18, and the container comprising a plastic material consisting of high-density polyethylene, the container having an average weight per unit surface area of from 0.04 to 0.09 g/cm$^2$.

* * * * *